US005438717A

United States Patent [19]

Wells

[11] Patent Number: 5,438,717

[45] Date of Patent: Aug. 8, 1995

[54] CANOPY SUPPORT

[76] Inventor: Robert T. Wells, Rte. 3, Box 389, Oliver Springs, Tenn. 37840

[21] Appl. No.: 199,828

[22] Filed: Feb. 22, 1994

[51] Int. Cl.[6] ..... A47C 29/00

[52] U.S. Cl. ..... 5/414; 135/116; 135/121

[58] Field of Search ..... 5/414; 135/101, 103, 135/106, 116; 297/184.1

[56] References Cited

U.S. PATENT DOCUMENTS

| | | | |
|---|---|---|---|
| 447,878 | 3/1891 | Jatho | 5/414 |
| 496,252 | 4/1893 | Eva | 5/414 |
| 678,739 | 7/1901 | Johnston | 135/106 |
| 768,757 | 8/1904 | Knott | 5/414 X |
| 1,297,308 | 3/1919 | Armfield | 5/414 |
| 2,044,659 | 6/1936 | Adams | 135/106 X |
| 2,144,747 | 1/1939 | Adams | 135/106 |
| 2,993,216 | 7/1961 | Casey | 5/414 |
| 4,069,527 | 1/1978 | Harris | 5/414 |

*Primary Examiner*—Michael F. Trettel
*Attorney, Agent, or Firm*—Michael E. McKee

[57] ABSTRACT

A canopy support for supporting a canopy above a bed or other desired area includes at least one support member including an elongated post positionable in an upright condition adjacent the bed or desired area and a base or other fastening members for maintaining the elongated post in an upright condition. Elongated support structure from which a canopy is to be supported is fixedly joined at one end to the support member so as to extend over the bed so that the elongated support structure is maintained in a free-standing condition above the bed or desired area and so that when the canopy is supported by the elongated support structure, the canopy overhangs the bed or desired area.

15 Claims, 7 Drawing Sheets

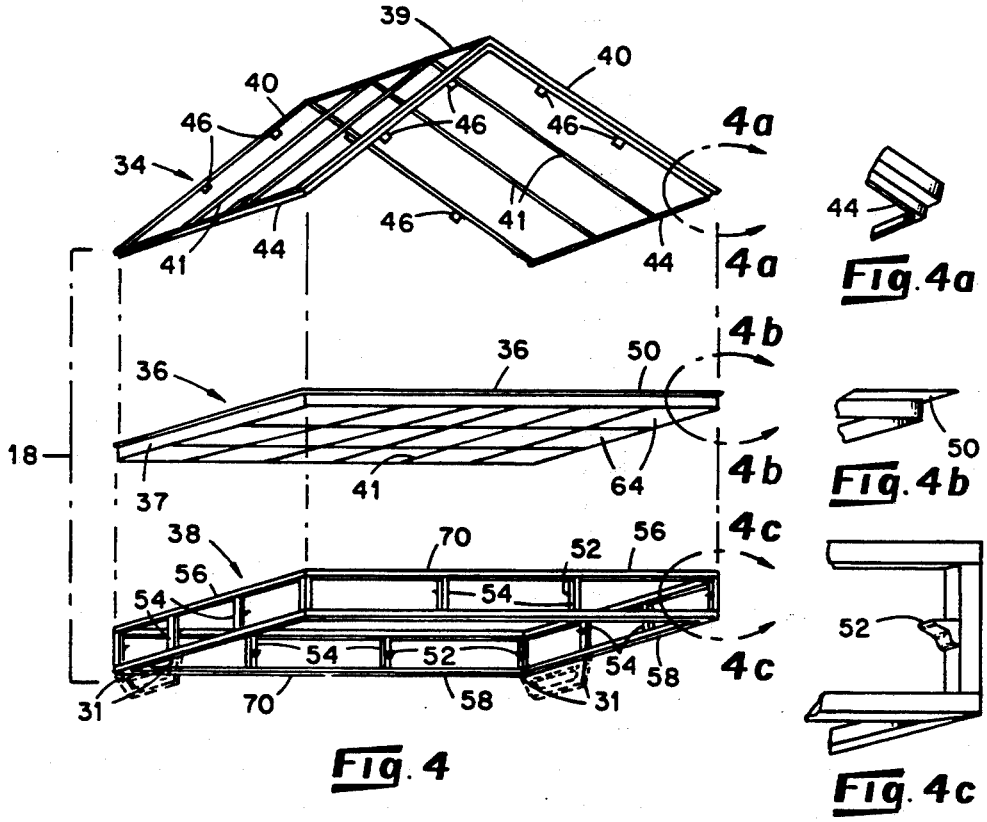
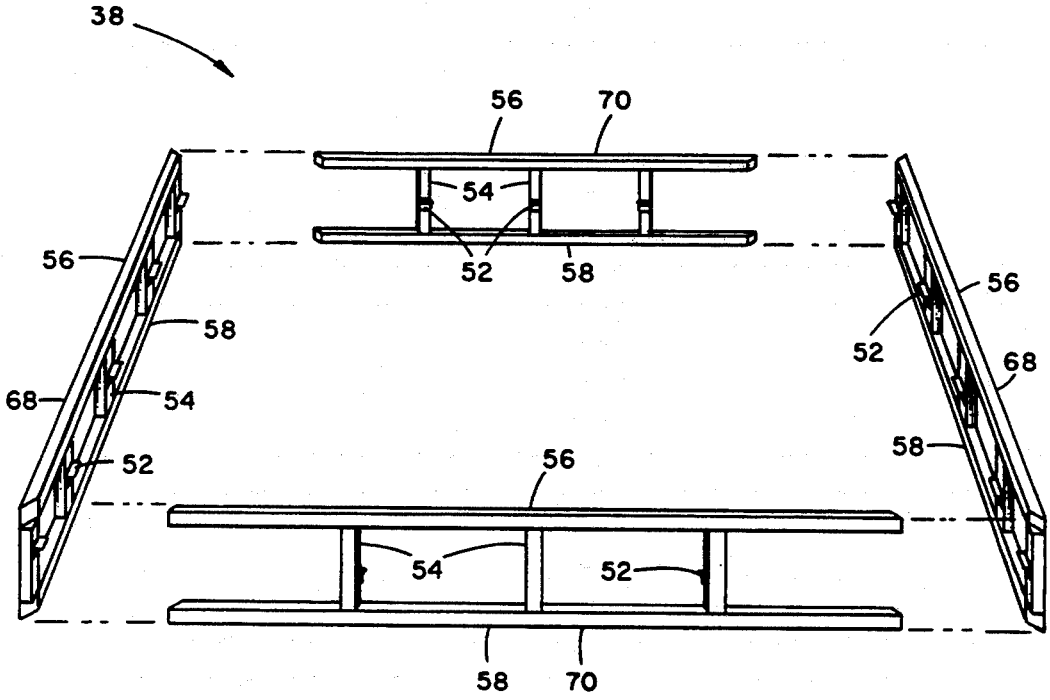
Fig. 5

CANOPY SUPPORT

BACKGROUND OF THE INVENTION

This invention relates generally to canopies and relates, more particularly, to means by which a canopy is supported over an underlying area.

Heretofore, canopies intended to overhang a desired area, which area may include a bed, were either supported by means of corner posts, e.g. four in number, or were suspended over an area from a wall or ceiling. Such canopy-supporting means presented drawbacks, especially when used in connection with beds. For example, when making a bed about which were positioned four canopy-supporting posts, an individual was likely to stub his foot or toe upon one of the support posts. Moreover, when relocating a wall-suspended or ceiling-suspended bed canopy from one location to another commonly required the removal and re-installation of supporting hardware and the filling, sanding and/or repainting of holes from which the supporting hardware is removed.

It would be desirable to provide a new and improved means for supporting a canopy above an underlying area.

Another object of the present invention is to provide such means which circumvents drawbacks associated with canopy-supporting means of the prior art.

Still another object of the present invention is to provide such means which, when used with a bed canopy, provides a unique and conversational accessory for the bedroom.

Yet another object of the present invention is to provide such means which, when used with a bed canopy, enhances the beauty of the bed.

A further object of the present invention is to provide such means which, when used with a bed canopy, enables the bed to be made easily, conveniently and with reduced obstruction.

A still further object of the present invention is to provide such means which, when used with a bed canopy, enables an individual to enter or get out of the bed at any of a number of angles and without obstruction.

A yet further object of the present invention is to provide a canopy frame for identifying, when finished with the appropriate material, the cultural background or national origin of the user.

One more object of the present invention is to provide a furnishing which is uncomplicated in construction and effective in operation.

SUMMARY OF THE INVENTION

This invention resides in a canopy support for supporting a canopy above a desired area.

The canopy support includes a frame having at least one support member including elongated post means positionable in an upright orientation adjacent the desired area, and means for maintaining the post means of the support member in an upright orientation. The frame also includes elongated support means associated with the support member from which a canopy is to be supported wherein the elongated support means is fixedly joined at one end to the support member so as to extend over the desired area so that the elongated support means is maintained in a free-standing condition above the desired area and so that when the canopy is supported by the elongated support means, the canopy overhangs the desired area.

When used in connection with a bed, this free-standing support reduces the likelihood that one who makes up the bed will stub his toe or foot, as is commonly the case with four-post bed canopies. Furthermore, the changing of position of the bed does not require the removal or relocation of support hardware, as is commonly the case with a wall-suspended or ceiling-suspended canopy, or does it necessitate the filling, sanding or repainting to fix holes from which such supporting hardware has been removed.

In addition to the use of the invention in connection with a bed canopy, the invention can be used to overhang a chair used in beauty pageants, a podium of visiting dignitaries or a lectern for a distinguished speaker.

BRIEF DESCRIPTION OF THE DRAWINGS

FIG. 4 is a perspective view of a portion of the framework of FIG. 2, shown exploded.

FIGS. 4*a*–4*c* are perspective views of fragments of the FIG. 4 framework, drawn to a slightly larger scale.

FIG. 5 is a perspective view of a section of the FIG. 4 framework portion.

DETAILED DESCRIPTION OF THE ILLUSTRATED EMBODIMENTS

Figure 1:
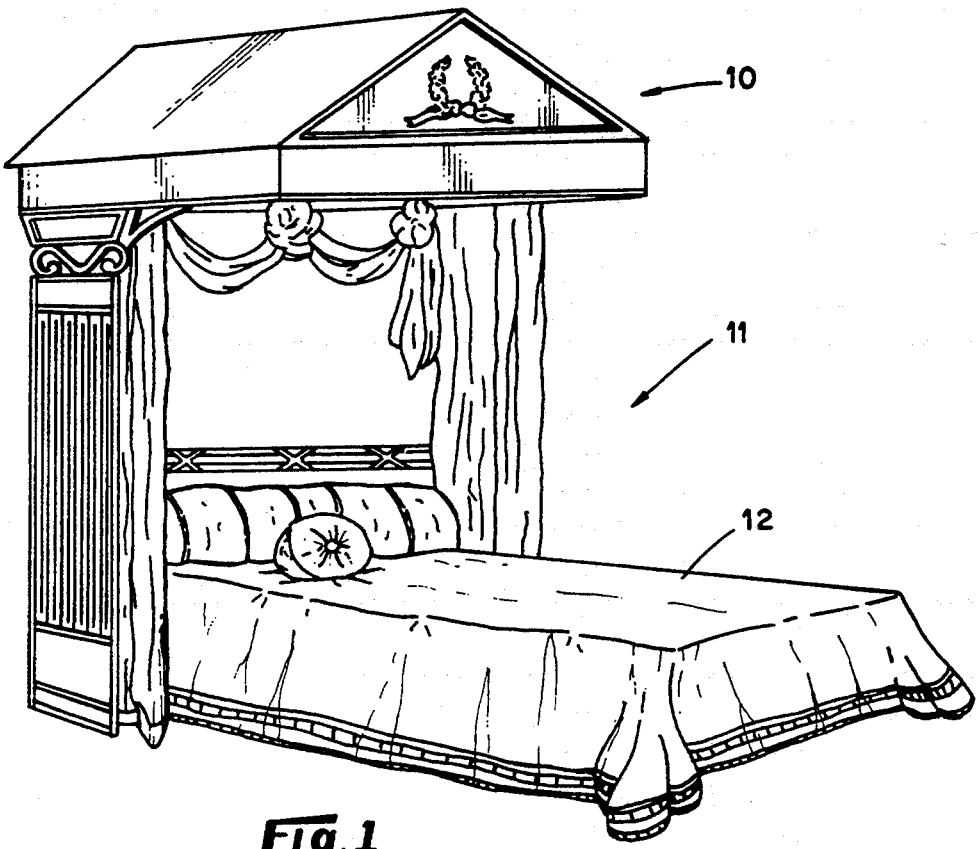
FIG. 1 is a perspective view of an embodiment of the present invention shown utilized in an environment of intended use.

Turning now to the drawings in greater detail and considering first FIG. 1, there is shown an embodiment, generally indicated 11, of the present invention used for supporting a canopy 10 so as to overhang a bed 12. Although the appearance of the depicted support embodiment 11 is shown in a style known as a Neo-classic style, it is to be understood that an embodiment in accordance with the present invention may take any of a variety of styles, such as traditional, oriental, French Provincial, modern, or art deco. Moreover, although the depicted embodiment 11 is described herein in connection with a bed canopy 10, it will be understood that the embodiment 11 can be used to support a canopy in other applications. For example, the embodiment 11 can be used to support a canopy over other objects, such as a chair, love seat, desk, podium or lectern. Accordingly, the principles of the present invention can be variously applied.

Figure 2:
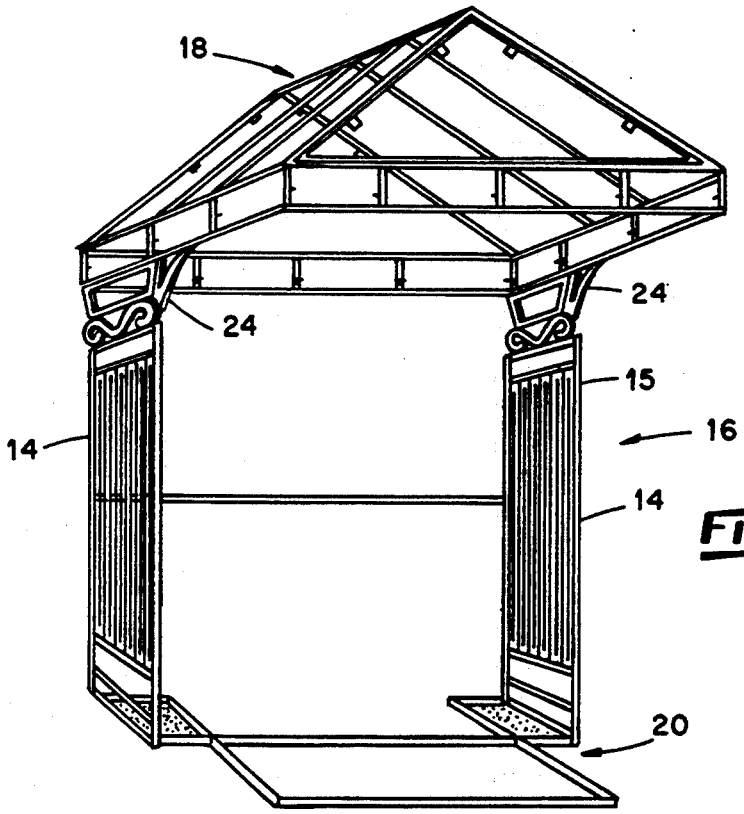
FIG. 2 is a perspective view of the framework of the FIG. 1 embodiment.

The depicted embodiment 11 is disposed adjacent the head of the bed 12 and supports the canopy 10 so that it extends from the bed head to a location situated about midway between the head and the foot of the bed 12. To this end and with reference to FIGS. 2 and 3, the support embodiment 11 includes frame means, generally indicated 15, providing a base or stabilizer 20, an upright support member 16 joined to so as to extend upwardly from the stabilizer 20, and elongated support means 18 joined to the upright support member 16 so as to extend over the area desired to be covered by the canopy 10. The canopy 10, which is comprised of a flexible fabric material sized to correspond with that of the elongated support means 18 is, in turn, draped over or otherwise supported from the elongated support means 18 so as to overhang the desired area, i.e. the bed 12. Associated within the frame means 15 are braces 24 which provide enhanced horizontal support to the elongated support means 18 thereby enabling the support means 18 to extend an appreciable distance over the bed. 12. During use, the braces 24 are load-bearing members and serve to anchor the support means 18.

The upright support member 16 of the depicted frame means 15 is somewhat H-like in shape and includes a pair of upstanding posts 14 disposed on the left and right sides of the member 16 and a cross member 22 which extends between so as to join the posts 14 together. The depicted posts 14 are each shown and described herein as relatively thin, substantially straight and generally parallel to the other post 14, the posts 14 may possess an alternative shape, such as curved, wavy or arced. However, it will be understood that the depicted posts 14 can be constructed of any of a number of suitable materials such as flat, rod-like or tubular steel, or wood or hard-molded plastic. Moreover, each of the depicted posts 14 extends along its corresponding side of the bed for a distance which is no greater than about 14.0 inches.

Each post 14 includes two stubs 25 located adjacent the level of the floor and another stub 27 located adjacent the vertical center of the post. The stub 27 is constructed of bar steel and has a cross section which is slightly smaller in size than that of the cross member 22 so that the stub 27 can be sleeved into a corresponding end of the cross member 22. The cross member 22 is secured at each end to a post 14 by means of a set screw 28 which is directed through an opening formed in the side of the cross member 22 and tightened against the surface of the stub 27. For construction of heavier units, bolts can be substituted for the set screws 28. In such an instance, holes can be drilled through both the cross member 22 and the stub 27, and the bolts can be inserted through the drilled holes and secured therein with nuts and washers.

Figure 3:
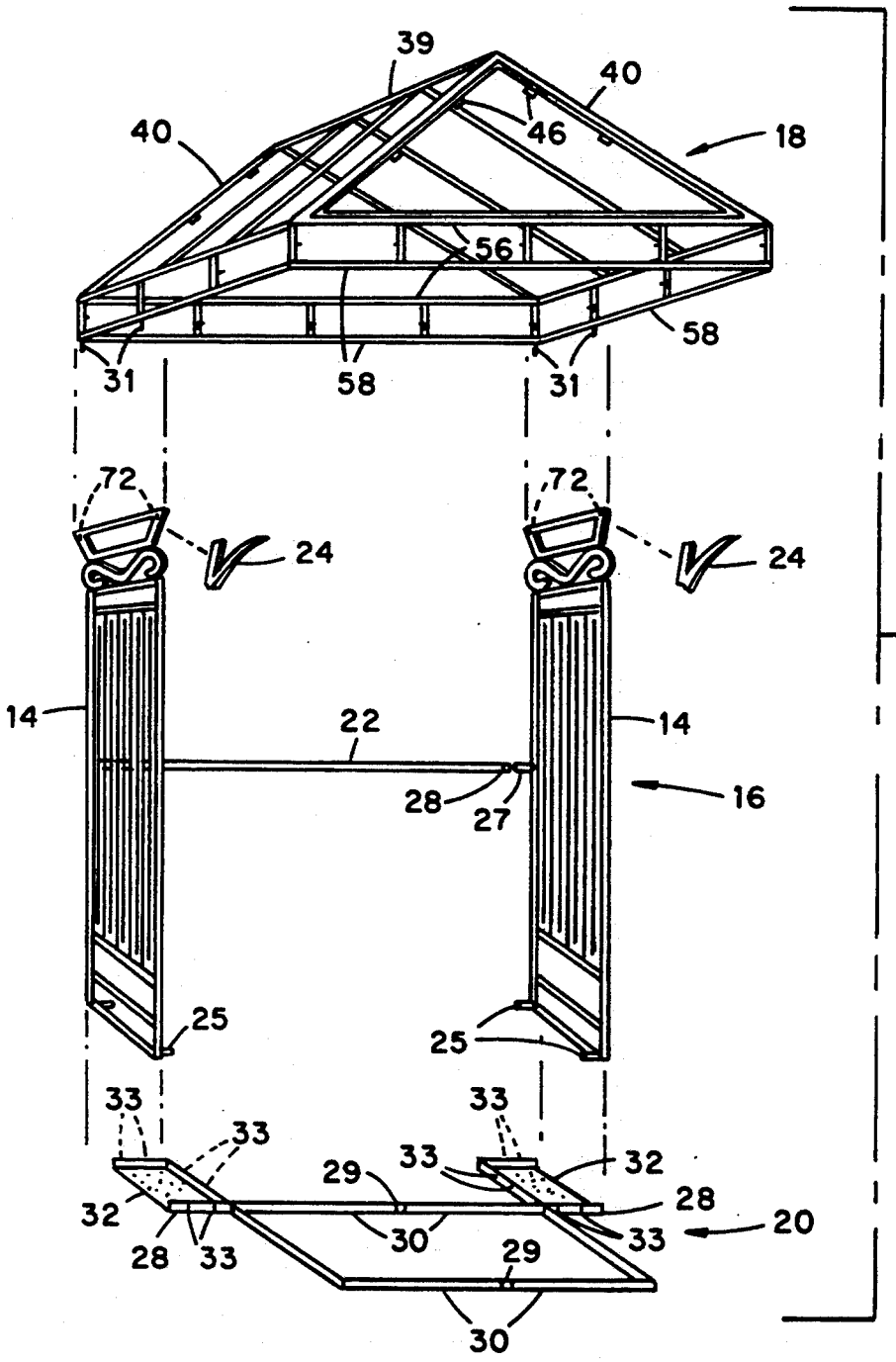
FIG. 3 is a perspective view of the framework of FIG. 2, shown exploded.

As best shown in FIG. 3, the stabilizer 20 is relatively expansive in form and is of two-part construction in that it includes two frame parts 29 which are each disposed adjacent a corresponding left or right side of the frame means 15 and which are attached together at locations situated about midway between the sides of the bed 12. Preferably, one part 29 includes a pair of tube-like cross members 30, 30 which are each telescopically accepted by the cross members 30, 30 of the other part 29, as shown in FIG. 3, and are fastened together by means of set screws so that the relative positions of the parts 29 can be adjusted to accommodate an adjustment in width of the frame means 15. When the embodiment 11 is positioned in its operative relationship with the bed 12, the stabilizer 20 extends beneath the head of the bed to a position preferably disposed within about 1.0 feet from the foot of the bed 12.

Each stabilizer part 29 includes a generally U-shaped arrangement of tubes 31, 33 and a metal plate 32 joined, e.g. welded, to each tube 31, 33 of the U. The metal plates 32 add strength to the stabilizer 20 and provides a platform upon which the headboard or,bed casters may be positioned, thus further steadying the bed canopy 10 supported by the frame means 15. Both metal plates 32 of the depicted support 11 are constructed of a relatively heavy gauge of stainless steel and are fixed to the cross bars 30 with sheet metal screws 31. The aforedescribed components of the depicted stabilizer 20 are constructed of tubular steel and, if desired, are reinforced at stress points with solid bar steel.

For joining the posts 14 of the upright support member 16 to the stabilizer 20, the ends of the tubes 31, 33 are sized to accept the stubs 25 inserted endwise therein. Thus, the stubs 25 (which are disposed adjacent the bottom of the posts 14) are inserted into the ends of the tubes 31, 33 of the stabilizer 20. Set screws 28 or, alternatively, nuts and bolts are directed through the sides of the tubes 31, 33 to secure the stubs 25 within the tubes 31, 33.

With reference to FIG. 4., the elongated support means 18 of the depicted support embodiment 11 is generally rectangular in overall form, when viewed in plan. It will be understood, however, that the elongated support means of another embodiment may be triangular, oval or possess some other geometric shape. The support means 18 is depicted in FIG. 4 as including a roof portion 34, a ceiling portion 36 and a header portion 38. The roof portion 34 of the support means 18 is fabricated (in the depicted example) of wooden strips 41 arranged on opposite sides of a ridge piece 39 so as to provide roof trusses 40. The trusses 40 are disposed at an angle so as to define a gabled pitch of the roof portion 34 and may be overlain with a fine mesh wire along with fabric and/or other material fixedly secured thereto. A strip 46 of wood or other suitable material, is joined along each of the lower edges of the trusses 40 to form ribs 44 which extend along the full length of the roof portion 34. As will be apparent herein, these ribs 44 permit the roof portion 34 to interfit with the underlying header portion 36.

If desired, the trusses 40 can be hingedly joined along the ridge piece 36 to render the roof portion 34 collapsible for shipping purposes or to render the pitch angle of the roof portion 34 adjustable to accommodate beds of different widths. It follows, therefore, that the ridge piece 39 joins the two sections of the trusses 40 and supports the canopy 10 at the ridge peak.

With reference still to FIG. 4, the ceiling portion 39 provides a ceiling in the elongated support means 18. Within the ceiling portion 36, square-shaped pieces of hardboard, such as is available under the trade designation Gatorboard, has been glued to a frame 66 comprised of wood strips, e.g. Balsa wood, arranged at right angles to form a coffered ceiling. The frame 66 is bordered by a lip portion 50 extending generally outwardly from the edges thereof.

The header portion 38 provides a base portion for the support means 18 and includes a first, square horizontal frame 56 having two sets of strips 68, comprised of wood or other suitable material, extending substantially parallel to the length of the bed 12 and joined at right angles to two other strips 70. Directly beneath the first frame 56 are positioned fourteen vertical struts 54 which join the first frame 56 to a second frame 58 and wherein the second frame 58 has a construction which is identical to that of the first frame 56. When the support means 18 is in its assembled condition and with reference to FIG. 3, the opening provided in the top of the first frame 56 accepts the lowermost section of the ceiling portion 50 so that the lip portion 50 of the ceiling portion 50 overlies and rests upon the upper edges of the frame 56.

For joining the support means 18 to the upright support members 16, the header portion 38 includes four wooden stubs 31 which project generally downwardly from the underside of the second frame 58 and are accepted by holes 72 (or other openings) provided in the uppermost tubes of the posts 14. Set screws extend through pre-formed holes provided in the sides of the uppermost tubes of the posts 14 and are tightened against the stubs 31 to secure the stubs 31 within the tubes of the posts 14.

Figure 6:
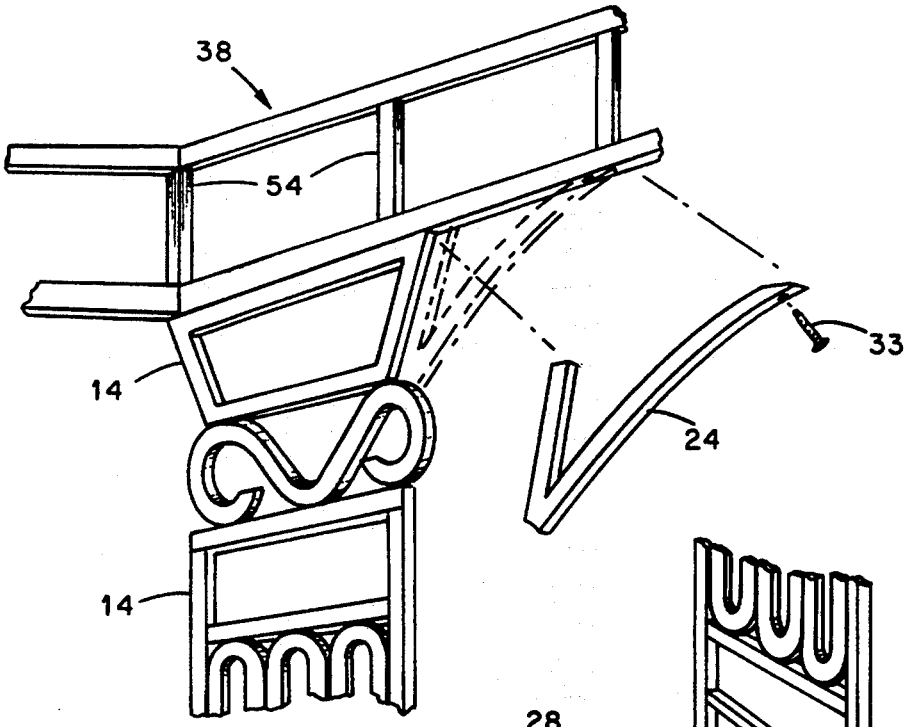
FIG. 6 is a perspective view of a fragment of the FIG. 1 embodiment, drawn to a larger scale.
Figure 7:
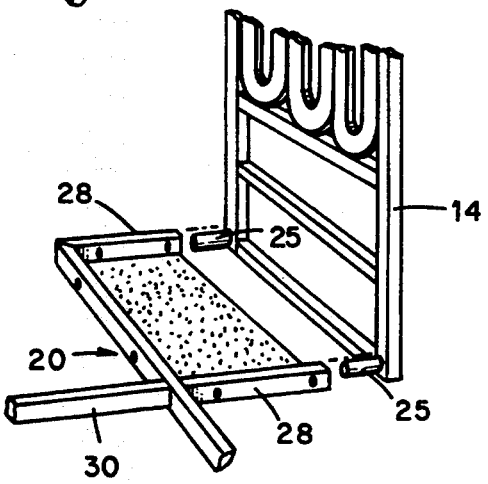
FIG. 7 is a perspective view of another fragment of the FIG. 1 embodiment, shown exploded.

The load-bearing braces 24, best shown in FIG. 6, located generally at the front and the upper ends of the posts 14 also serve to further secure the support means 18 to the upright support member 16 and enhances the capacity of the embodiment 11 to support the elongated support means 28 in its cantilevered, horizontal position over the bed 12. A set screw 33 is installed through a pre-formed opening provided in the upper end of each brace 24 and tightened against the underside surface of the header portion 38 thereby reducing the likelihood that the header portion 38 will twist in the horizontal plane.

Figure 8:
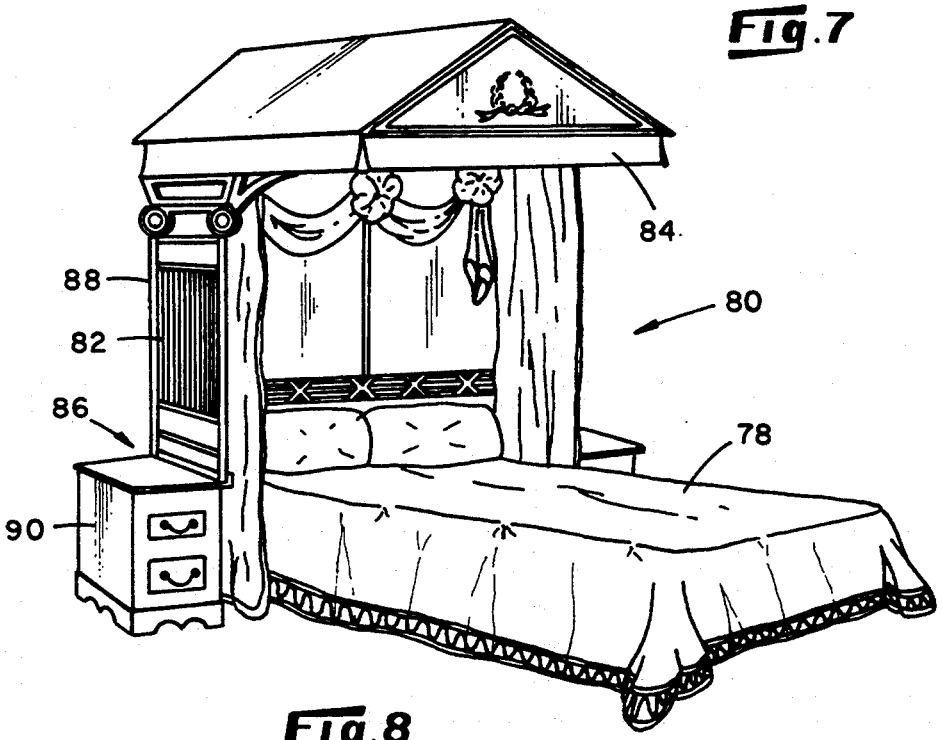
FIG. 8 is a perspective view of another canopy-supporting embodiment shown utilized with a bed and night stands.

It will be understood that numerous modifications and substitutions can be had to the aforedescribed embodiment without departing from the spirit of the invention. For example, although the aforedescribed embodiment 11 has been shown and described as including a relatively expansive stabilizer, or base, 20 for supporting the support member 16 in an upright condition, an embodiment in accordance with the broader aspects of the present invention may include alternative means for supporting the support member. For example, there is shown in FIG. 8 a support embodiment, generally indicated 80, having a support member 82 from which elongated support means 84 is supported in a cantilevered condition and means, generally indicated 86, for maintaining the support member 82 in an upright, generally vertical condition adjacent a bed 78. In this connection and with reference to FIG. 9, the support member 82 includes a pair of side posts 88 positionable on opposite sides of the bed 12 upon adjacent objects, Such as night stands 90, situated on opposite sides of the bed 12 and a pair of posts 89 disposed intermediate of the posts 88.

Figure 10:
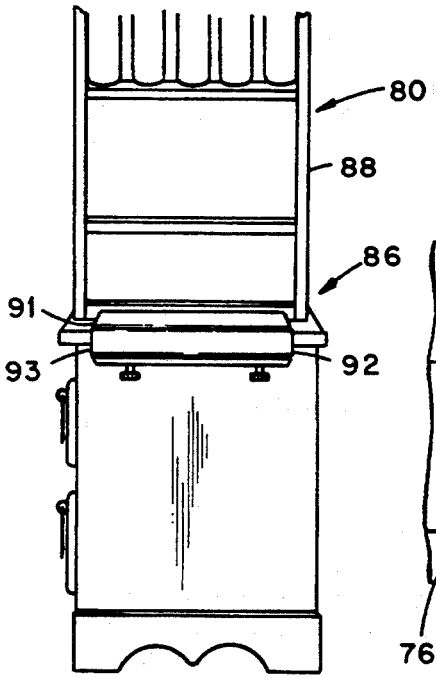
FIG. 10 is a side elevational view of one fragment of the FIG. 8 embodiment.

In this embodiment 80, the maintaining means 86 includes means for fixedly securing each side post 88 upon a corresponding one of the night stands 90 so that the post 88 is maintained in an upright, substantially vertical condition. In this connection, each side post 88 has a laterally-extending support foot 91 (best shown in FIG. 10) which overlies the top of a corresponding night stand 90 adjacent and edge thereof, and the maintaining means 86 includes a pair of C-clamp members 92 (having elongated jaws 93) wherein each C-clamp member 92 is positionable about a corresponding support foot 91 and the adjacent night stand edge for stably securing the post 88 to the night stand 90.

Figure 11:
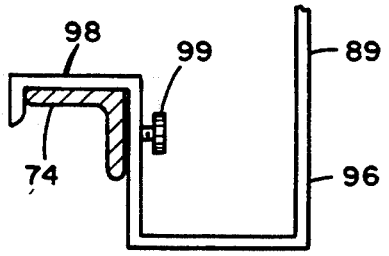
FIG. 11 is a cross-sectional view taken about along line 11—11 of FIG. 9.

To further enhance the stability of the support member 92 in its desired upright orientation, the maintaining means 86 includes means for securing the intermediate posts 89 to the frame of the bed 78. In this connection, the frame of the bed 78 includes a transversely-extending bar 74 (which is substantially L-shaped in cross section as viewed in FIG. 11), and each post 89 terminates at it lower end with a bracket portion 96 having a U-shaped flange 98 adapted to overlie the bar 74. A set screw 99 is threadably received by a preformed opening provided in one side of the U-shaped flange 98 and tightened against a leg of the bar 74 to secure the flange 98 to the bar 74.

Figure 9:
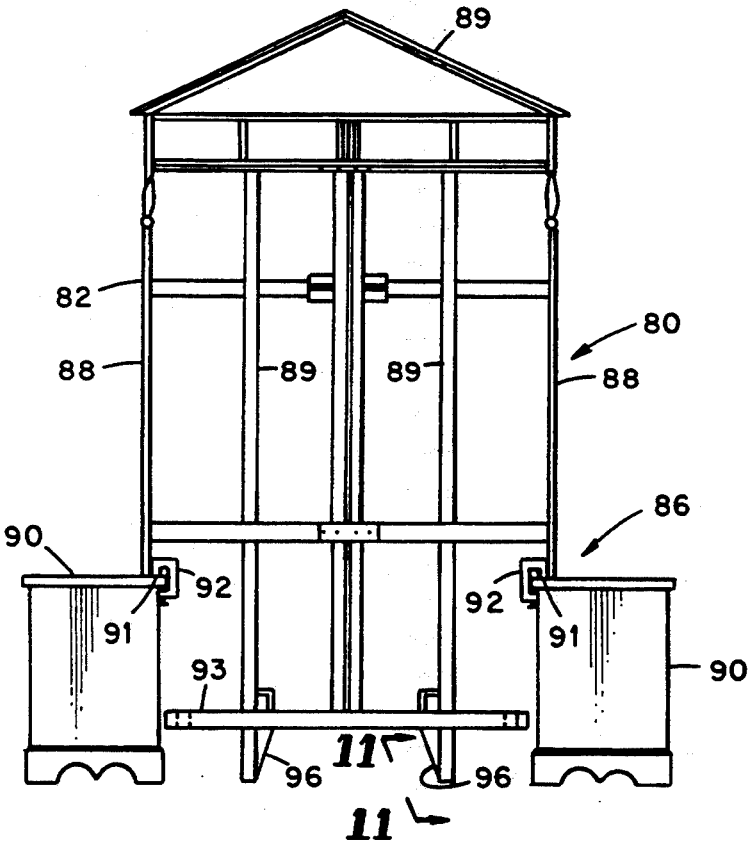
FIG. 9 is a rear elevational view of the FIG. 8 embodiment as seen from the back in FIG. 8.
Figure 12:
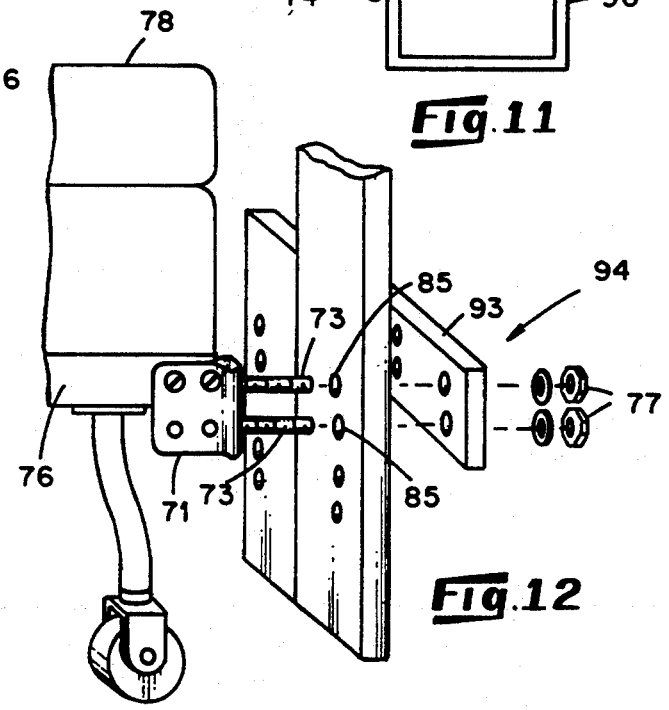
FIG. 12 is a perspective view of another fragment of the FIG. 8 embodiment.

The support member 82 of the depicted embodiment 80 also includes a transversely-extending bar 93 as shown in FIG. 9, and the maintaining means 86 also includes an attachment assembly 94 (FIG. 12) for attaching the bar 93 to the bed frame, indicated 76 in FIG. 12. In the depicted embodiment 80 and with reference still to FIG. 12, the attachment assembly 94 includes a bracket 71 fixedly secured with bolts to a side bar of the bed frame 76 and a pair of studs 73 which extend from the brackets 71. The studs 73, in turn, are inserted through pre-formed openings 85 provided in the bar 93 (adjacent an end thereof), and nuts 77 are tightened upon the studs 73 to secure the bar 93 to the bracket 71.

Figure 13:
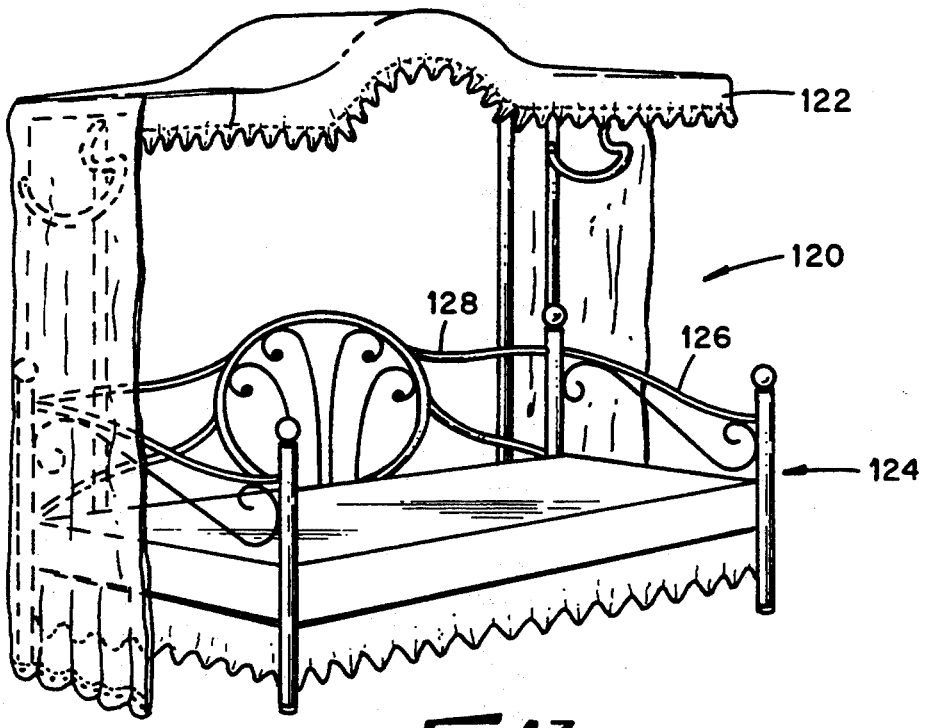
FIG. 13 is a perspective view of still another canopy-supporting embodiment shown utilized with a daybed.
Figure 14:
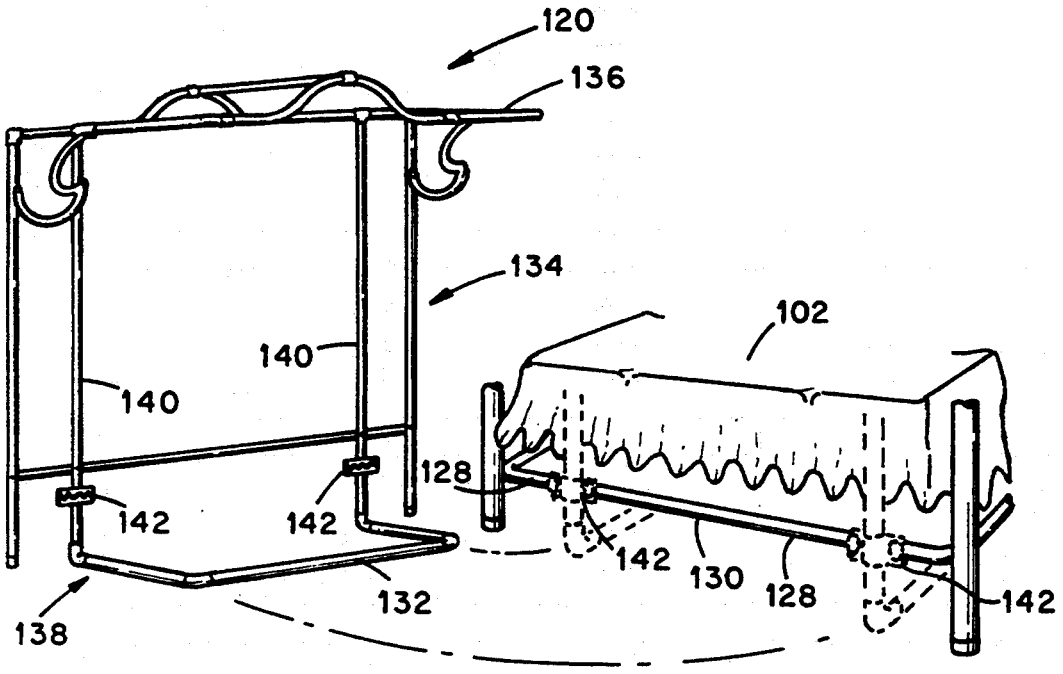
FIG. 14 is a perspective view of the FIG. 13 support shown in a spaced relationship with the back of the daybed.

Further still, there is shown in FIGS. 13 and 14 yet another canopy-supporting embodiment 120 used to support a canopy 122 above a daybed 124. The daybed 124 includes a frame 126 of tubular metal having a back section 128 including a horizontally-disposed cross piece 130 (best shown in FIG. 14). The embodiment 120 includes a support member 134 from which elongated support means 136 is supported in a cantilevered condition over the daybed 124 and means, generally indicated 138, for maintaining the support member 134 in an upright, generally vertical condition adjacent the back section 128 of the daybed 124. To this end, the support member 134 includes a plurality of posts 140 which extend generally upwardly from the floor to the elongated support means 136 and the maintaining means 138 includes a base 132 joined to the posts 140 at the lower ends thereof for extending beneath the daybed 124. The maintaining means 138 also includes securement clamps 142, or alternative fasteners, for securing the support member posts 140 to the cross piece 130 (as viewed in phantom in FIG. 14) to enhance the stability of the posts 140 in a vertical orientation.

Figure 15:
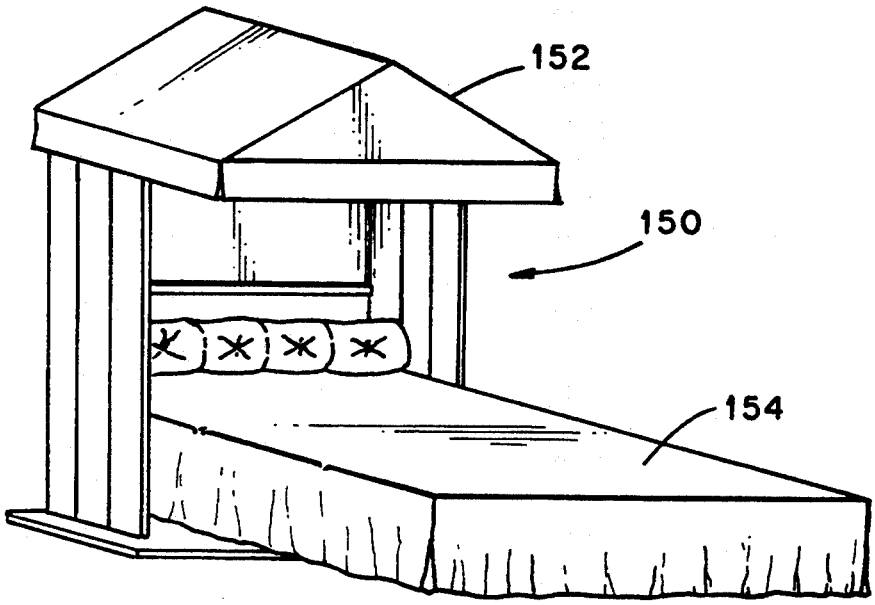
FIG. 15 is a perspective view of a further canopy-supporting embodiment shown utilized with a bed.
Figure 16:
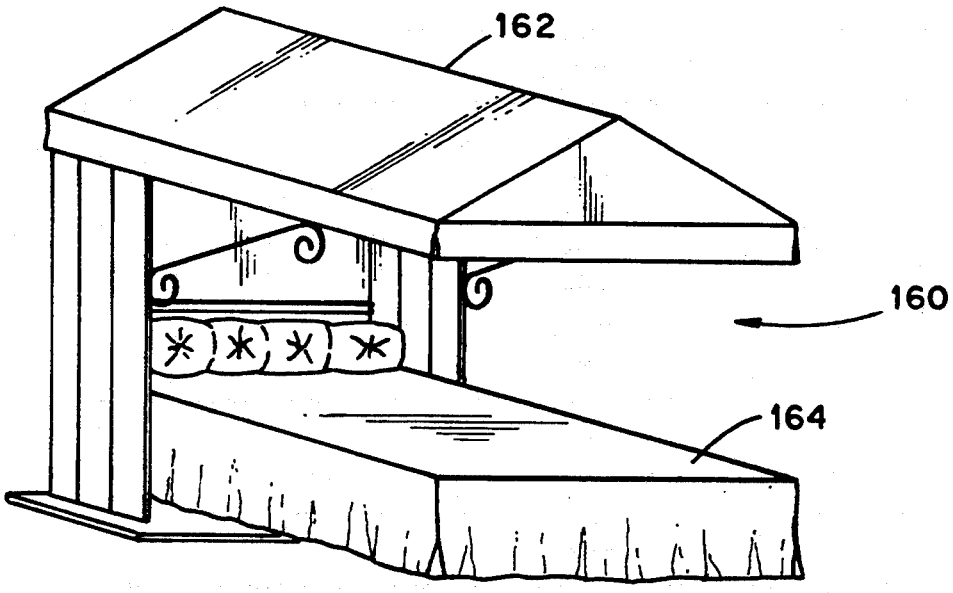
FIG. 16 is a perspective view of a still further canopy-supporting embodiment shown utilized with a bed.

Yet still further, although the embodiment 11 has been shown and described above as including elongated support means 18 for supporting a canopy 10 from a position located adjacent the head of the bed 12 to a position located about midway along the length of the bed 12, a support embodiment may include elongated support means for supporting a canopy for an alternative distance along the length of the bed. For example, there is shown in FIG. 15 a support embodiment 150 for supporting a canopy 152 above a bed 154 for a distance therealong which is equal to about one-fourth the length of the bed 154. Furthermore, there is shown in FIG. 16 a support embodiment 160 for supporting a canopy 162 above a bed 164 for a distance therealong which is equal to about the full length of the bed 164.

Yet further still, although the maintaining means of the aforedescribed embodiments have been shown and described as cooperable with the floor, bed frame or some other object situated adjacent a bed for supporting a support member in a substantially upright orientation, the maintaining means can include means for securing a support member to a wall. Accordingly, the aforedescribed embodiments are intended for the purpose of illustration and not as limitation.

I claim:

1. A canopy support for supporting a canopy above a bed including floor-mounted bed-supporting structure, the canopy support comprising:

a frame independent of the bed or it's floor-mounted bed-supporting structure including a) at least one support member including elongated post means positionable in an upright condition adjacent the bed;

b) means for maintaining the post means of the support member in an upright condition including a base connected to the elongated post means and adapted to rest upon the floor which underlies the bed so that the canopy is supportable by the canopy support independent of support from the bed, the base having a relatively low height to accommodate the positioning of the bed over or atop the base; and c) elongated support means associated with the support member from which a canopy is to be supported, the elongated support means being fixedly joined at one end to the support member so as to extend over the bed so that the support means is maintained in a free-standings, cantilevered condition above the bed and so that when the canopy is supported by the elongated support means, the canopy overhangs the bed.

2. The support as defined in claim 1 wherein the support member is positionable adjacent one edge of the bed, and the base of the maintaining means is joined to the elongated post means adjacent the one edge.

3. The support as defined in claim 2 wherein the base includes a foot member for extending beneath the bed from one edge thereof.

4. The support as defined in claim 3 wherein the foot member extends beneath the bed from the one edge thereof to a position disposed within about 1.0 feet from the edge of the bed opposite said one edge.

5. The support as defined in claim 1 wherein the frame includes two support members and each of the two support members is disposed adjacent one edge of the bed and is also disposed adjacent a corresponding corner of the one bed edge.

6. The support as defined in claim 5 wherein the two support members are disposed along opposite sides of the bed and extend therealong for a distance which is no greater than about 14.0 inches.

7. The support as defined in claim 5 wherein each support member includes a section which is substantially rectangular in cross section.

8. The support as defined in claim 1 wherein the elongated support means is joined at one end to the support member so that the opposite end of the support means extends over the bed portion from a position disposed generally above the one edge of the bed.

9. The support as defined in claim 8 wherein the elongated support means includes means providing a relatively expansive horizontally-oriented platform from which the canopy can be hung so that when hung from the platform-providing means, the canopy overhangs a relatively expansive portion of the bed.

10. The support as defined in claim 8 wherein the elongated support means extends from the position disposed generally above the one edge of the bed to a position disposed generally above the edge of the bed opposite the one edge.

11. The support as defined in claim 8 wherein the elongated support means extends from the position disposed generally above the one edge of the bed to a position disposed generally above a location on the bed situated substantially midway between the one edge of the bed and the edge of the bed opposite the one edge.

12. The support as defined in claim 8 wherein the elongated support means extends from the position disposed generally above the one edge of the bed to a position disposed generally above a location on the bed situated between the one edge of the bed and the edge of the bed opposite the one edge.

13. The support as defined in claim 1 in combination with a canopy adapted to be supported by the support frame.

14. For use with a bed including floor-mounted bed-supporting structure, a canopy assembly comprising:

a canopy; and a canopy support for supporting the canopy above at least a portion of the bed including a frame independent of the bed or it's floor-mounted bed-supporting structure having a) at least one support member including elongated post means positionable in an upright condition adjacent the bed;

b) means for maintaining the elongated post means in an upright condition including a base connected to the elongated post means and adapted to rest upon a floor or surface which underlies the bed so that the canopy is supportable by the canopy support independent of support from the bed or any item situated adjacent the bed, the base having a relatively low height to accommodate the positioning of the bed over or atop the base; and c) elongated support means associated with the support member from which a canopy is to be supported, the elongated support means being fixedly joined at one end to the elongated post means so as to extend over the bed so that the support means is maintained in a free-standing, cantilevered condition above the bed and so that when the canopy is supported by the elongated support means, the canopy overhangs the bed.

15. A canopy support for supporting a canopy above a bed, the canopy support comprising:

a frame including a) at least one support member including elongated post means positionable in an upright condition adjacent the bed;

b) means for maintaining the post means of the support member in an upright condition; and c) elongated support means associated with the support member from which a canopy is to be supported, the elongated support means being fixedly joined at one end to the support member so as to extend over the bed so that the support means is maintained in a free-standing condition above the bed and so that when the canopy is supported by the elongated support means, the canopy overhangs the bed;

the support member is positionable adjacent one edge of the bed, and the maintaining means includes a base joined to the elongated support member adjacent the one edge and which is adapted to rest upon the floor which underlies the bed;

the base includes a foot member for extending beneath the bed from the one edge thereof; and the foot member extends beneath the bed from the one edge thereof to a position disposed within about 1.0 feet from the edge of the bed opposite said one edge.

* * * * *